US011037719B2

(12) United States Patent
Igarashi et al.

(10) Patent No.: US 11,037,719 B2
(45) Date of Patent: Jun. 15, 2021

(54) COIL COMPONENT

(71) Applicant: Murata Manufacturing Co., Ltd., Kyoto-fu (JP)

(72) Inventors: Akio Igarashi, Nagaokakyo (JP); Yuuji Igarashi, Nagaokakyo (JP); Kenji Hashimoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 380 days.

(21) Appl. No.: 16/169,685

(22) Filed: Oct. 24, 2018

(65) Prior Publication Data

US 2019/0156990 A1 May 23, 2019

(30) Foreign Application Priority Data

Nov. 18, 2017 (JP) ..... JP2017-222336

(51) Int. Cl.
*H01F 27/24* (2006.01)
*H01F 27/28* (2006.01)
(Continued)

(52) U.S. Cl.
CPC ..... *H01F 27/2823* (2013.01); *H01F 17/045* (2013.01); *H01F 27/24* (2013.01); *H01F 27/263* (2013.01); *H01F 27/38* (2013.01)

(58) Field of Classification Search
CPC .. H01F 27/2823; H01F 27/263; H01F 17/045; H01F 27/38; H01F 27/24
See application file for complete search history.

(56) References Cited

U.S. PATENT DOCUMENTS 6,965,289 B2 11/2005 Toi et al.
10,483,027 B2 * 11/2019 Miyamoto ..... H01F 27/263
(Continued)

FOREIGN PATENT DOCUMENTS

JP H01181403 A 7/1989
JP H08279416 A 10/1996
(Continued)

OTHER PUBLICATIONS

An Office Action; "Notification of Reasons for Refusal," mailed by the Japanese Patent Office dated May 26, 2020, which corresponds to Japanese Patent Application No. 2017-222336 and is related to U.S. Appl. No. 16/169,685 with English language translation.
(Continued)

*Primary Examiner* — Tuyen T Nguyen
(74) *Attorney, Agent, or Firm* — Studebaker & Brackett PC

(57) ABSTRACT

A coil component includes a drum core including a winding core portion and a flange portion disposed on an end portion thereof the winding core portion in its axial direction, a planar core having a lower principal surface, and a wire wound around the winding core portion. The flange portion includes an inner end surface, an outer end surface, a bottom surface, and a top surface. The inner end surface positions the end portion of the winding core portion. The bottom surface links the inner end surface and the outer end surface and placed so as to face a mounting substrate side when being mounted. The lower principal surface of the planar core is fixed to the top surface with an adhesive interposed therebetween. The top surface includes a protrusion with a vertex positioned closer to the inner end surface than to the outer end surface.

20 Claims, 9 Drawing Sheets

(51) Int. Cl.

| | |
|---|---|
| ***H01F 27/26*** | (2006.01) |
| ***H01F 17/04*** | (2006.01) |
| ***H01F 27/38*** | (2006.01) |

(56) References Cited

U.S. PATENT DOCUMENTS

| | | | | |
|---|---|---|---|---|
| 10,867,736 | B2 * | 12/2020 | Kojima | H01F 27/292 |
| 2018/0019046 | A1 * | 1/2018 | Miyamoto | H01F 41/10 |
| 2019/0088400 | A1 * | 3/2019 | Kanbe | H01F 27/2823 |

FOREIGN PATENT DOCUMENTS

| | | | |
|---|---|---|---|
| JP | 2003-168611 | A | 6/2003 |
| JP | 2007-059807 | A | 3/2007 |
| JP | 2009-302321 | A | 12/2009 |
| JP | 2011-035147 | A | 2/2011 |
| JP | 2014-099587 | A | 5/2014 |
| JP | 5796603 | B2 | 10/2015 |

OTHER PUBLICATIONS

An Office Action; "Notification of Reasons for Refusal," Mailed by the Japanese Patent Office dated Jan. 28, 2020, which corresponds to Japanese Patent Application No. 2017-222336 and is related to U.S. Appl. No. 16/169,685; with English language translation.

* cited by examiner

COIL COMPONENT

CROSS-REFERENCE TO RELATED APPLICATION

This application claims benefit of priority to Japanese Patent Application No. 2017-222336, filed Nov. 18, 2017, the entire content of which is incorporated herein by reference.

BACKGROUND

Technical Field

The present disclosure relates to coil components and in particular to a coil component including a drum core and a planar core.

Background Art

One example known technique is described in Japanese Patent No. 5796603. FIG. 14 is created on the based on FIG. 2(a) in Japanese Patent No. 5796603 and illustrates one flange portion 2 of a drum core 1 and a planar core 3 in a coil component.

The drum core 1 includes a winding core portion around which a wire is wound and first and second flange portions on the respective end portions of the winding core portion. FIG. 14 illustrates one flange portion 2 of the first and second flange portions. The flange portion 2 has an inner end surface (not illustrated) facing the winding core portion side and positioning the end portion of the winding core portion, an outer end surface 4 facing an outer side opposite to the winding core portion side, a bottom surface 5 linking the inner end surface and the outer end surface 4 and placed so as to face a mounting substrate side when being mounted, and a top surface 6 opposite to the bottom surface 5.

The planar core 3 has a lower principal surface 7 and an upper principal surface 8 facing in mutually opposite directions. The lower principal surface 7 of the planar core 3 is fixed to the top surface 6 with an adhesive 9 interposed therebetween.

Japanese Patent No. 5796603 discloses a structure that can provide high bonding strength between the drum core 1 and planar core 3 even with a small amount of the adhesive 9. Specifically, the illustrated flange portion 2 has a flat surface 10 positioned at the highest level in a central portion 11 of the top surface 6 and has inclined surfaces 12 and 13 inclined downward from the flat surface 10 toward the end surfaces. Each of the flat surface 10 and the inclined surfaces 12 and 13 is made of a plane.

In the coil component in Japanese Patent No. 5796603, the top surface 6 of the flange portion 2 and the lower principal surface 7 of the planar core 3 are in direct contact with each other at the flat surface 10 in the central portion 11 without the adhesive 9 therebetween and are opposed to each other with a gap interposed therebetween that is gradually narrower from the end surface of the top surface 6 toward the central portion of the top surface 6, and the adhesive 9 is arranged in the gap.

With the technique described in Japanese Patent No. 5796603, because a capillary phenomenon can be produced on the central portion side in the vicinity of the flat surface 10 of the top surface 6 in the gap, the space between the flange portion 2 and planar core 3 can be filled with a minimum amount of the adhesive 9. Thus, according to Japanese Patent No. 5796603, a relatively high bonding strength between the drum core 1 and planar core 3 is obtainable with a relatively smaller amount of the adhesive 9.

SUMMARY

In the case of the coil component described in Japanese Patent No. 5796603, however, the top surface 6 of the flange portion 2 and the lower principal surface 7 of the planar core 3 are in direct contact with each other at the flat surface 10 in the central portion 11 of the top surface 6, and the adhesive 9 is absent in that region. This means a reduction in bonding area. There is no denying that a reduced bonding area leads to a reduction in bonding strength between the top surface 6 of the flange portion 2 and the lower principal surface 7 of the planar core 3. In particular, when the coil component is miniaturized, for example, to plane dimensions of less than about 1 mm, such as about 0.4 mm×about 0.2 mm or about 0.2 mm×about 0.1 mm, the reduction in bonding area has a serious effect on the reduction in bonding strength.

In the coil component described in Japanese Patent No. 5796603, one approach to increasing the bonding strength between the top surface 6 of the flange portion 2 and the lower principal surface 7 of the planar core 3 is to decrease the area of the flat surface 10 in the central portion 11 of the top surface 6 and, in return, extend the area of the inclined surfaces 12 and 13, which allow the presence of the adhesive 9. Unfortunately, however, this approach will be confronted with problems described below.

In the above-described coil component, each of the drum core 1 and planar core 3 may be made of a magnetic material, such as ferrite. Thus, the planar core 3 constitutes a closed magnetic path in coordination with the drum core 1. In this closed path, a gap between the planar core 3 and drum core 1 causes magnetic resistance. If the area of the inclined surfaces 12 and 13 is increased, as previously described, the magnetic resistance increases, and this results in a reduction in inductance of the coil component.

Hence it is difficult to achieve both satisfactory bonding strength and inductance.

Accordingly, the present disclosure provides a coil component having a structure capable of both achieving an adequate bonding strength in a portion where a drum core and a planar core are bonded together and suppressing a reduction in inductance.

According to one embodiment of the present disclosure, a coil component includes a drum core including a winding core portion and a flange portion disposed on an end portion of the winding core portion in an axial direction thereof and made of a magnetic material, a planar core having a lower principal surface and made of a magnetic material, and a wire wound around the winding core portion.

The flange portion includes an inner end surface, an outer end surface, a bottom surface, and a top surface. The inner end surface faces an inner side being near the winding core portion and positions the end portion of the winding core portion. The outer end surface faces an outer side being opposite to the inner side. The bottom surface links the inner end surface and the outer end surface and placed so as to face a mounting substrate side when being mounted. The top surface is opposite to the bottom surface.

The lower principal surface of the planar core is fixed to the top surface with an adhesive interposed therebetween. The top surface includes a protrusion with a vertex positioned closer to the inner end surface than to the outer end surface.

Because the vertex of the protrusion is positioned closer to the inner end surface, the magnetic resistance in a section with a shorter path of the magnetic path formed of the drum core and planar core can be reduced. In addition, because it is not necessary to have direct contact between the top surface of the flange portion and the lower principal surface of the planar core, a large bonding area can be ensured.

The top surface in the above-described coil component may preferably be closest to the lower principal surface at the vertex. In this configuration, a stable magnetic path can be achieved in a section with a shorter path of the magnetic path formed of the drum core and planar core.

An interval between the top surface and the lower principal surface on a side near to the outer end surface with respect to the vertex in the above-described coil component may preferably widen from a side near to the inner end surface toward the side near to the outer end surface. In this configuration, the adhesive can be smoothly interposed between the top surface of the flange portion and the lower principal surface of the planar core.

The adhesive in the above-described coil component may preferably be present over substantially all of a region where the top surface and the lower principal surface face each other, the region containing the protrusion. In this configuration, the adhesive can be interposed between the flange portion and the planar core without having to rely on capillary action, and the bonding area between the flange portion and the planar core can be enlarged sufficiently. Consequently, the bonding strength between the flange portion and the planar core can be improved sufficiently.

The top surface in the above-described coil component may preferably further include a second protrusion with a vertex in a position different from the vertex of the protrusion. In this configuration, the state in which the planar core is supported at two points with respect to the top surface can be achieved, and the attitude of the planar core with respect to the drum core can be maintained stable.

The drum core in the above-described coil component may preferably include a second flange portion disposed on a second end portion of the winding core portion opposite to the end portion in the axial direction. The second flange portion may preferably have a second top surface facing the same side as the top surface and including a third protrusion with a vertex positioned closer to a surface of the second flange portion on the inner side than to a surface thereof on the outer side, and when viewed from the axial direction, the vertex of the third protrusion may preferably be located between the vertex of the first protrusion and the vertex of the second protrusion. The vertex of the third protrusion may preferably be positioned in a central portion of the second top surface when viewed from the axial direction.

In this configuration, the attitude of the planar core is more stabilized, and the magnetic resistance between the flange portion and the planar core is stable. Therefore, variations in inductance of the coil component can be suppressed.

A length of the planar core along the axial direction in the above-described coil component may be shorter than that of the drum core. In this configuration, if the planar core is slightly displaced with respect to the drum core, the external shape of the coil component can be recognized on the basis of the external shape of the drum core in a mounting state, and thus the mounting position of the coil component can be accurately determined by image recognition.

According to the present disclosure, the magnetic resistance in a section with a shorter path of the magnetic path formed of the drum core and planar core can be reduced.

In addition, a wide bonding area can be ensured. Accordingly, an adequate bonding strength between the drum core and the planar core is obtainable, and at the same time, a reduction in inductance can be suppressed.

Other features, elements, characteristics and advantages of the present disclosure will become more apparent from the following detailed description with reference to the attached drawings.

DETAILED DESCRIPTION

Figure 1:
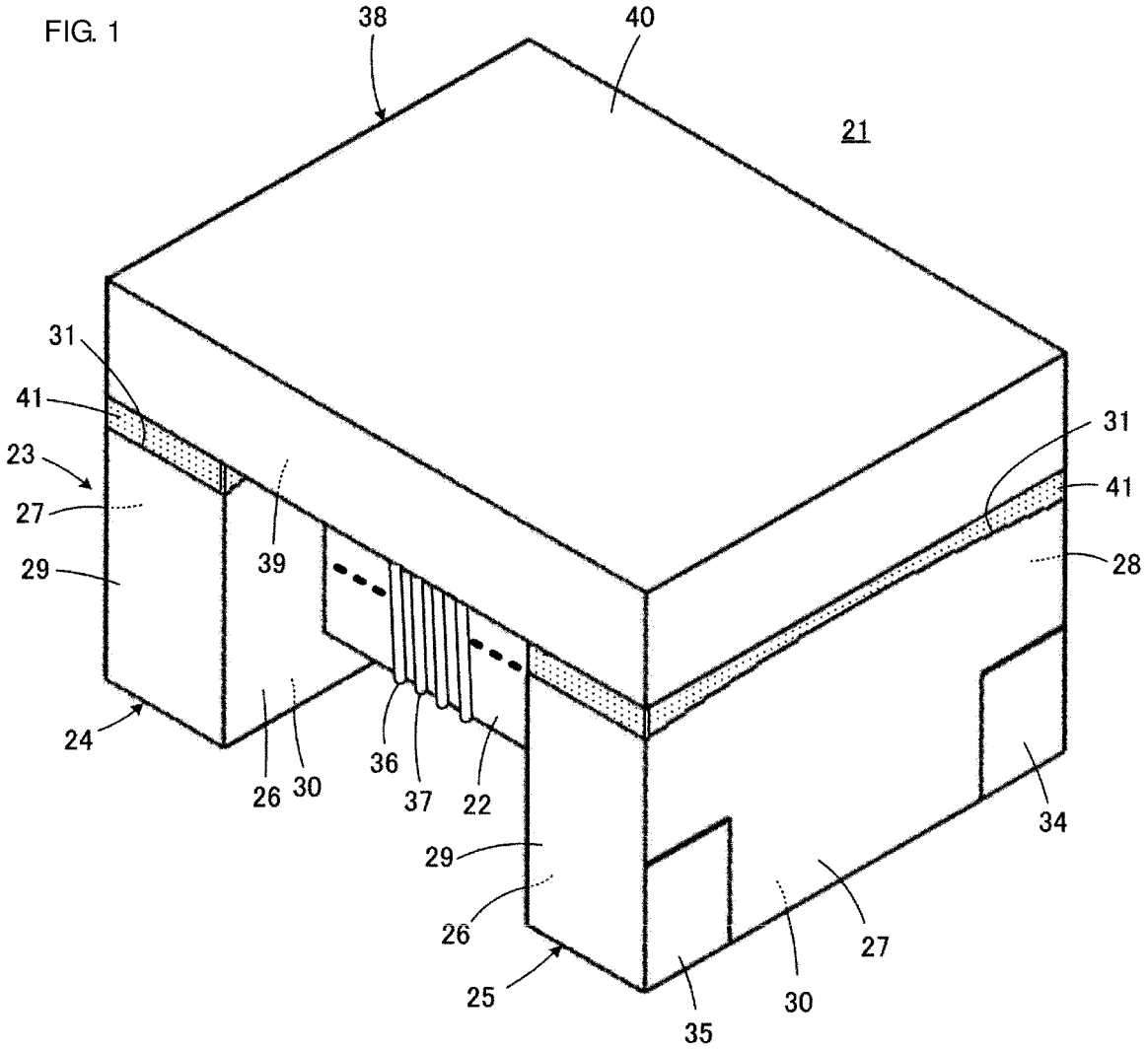
FIG. 1 is a perspective view that illustrates an outer appearance of a coil component according to a first embodiment of the present disclosure.
Figure 2:
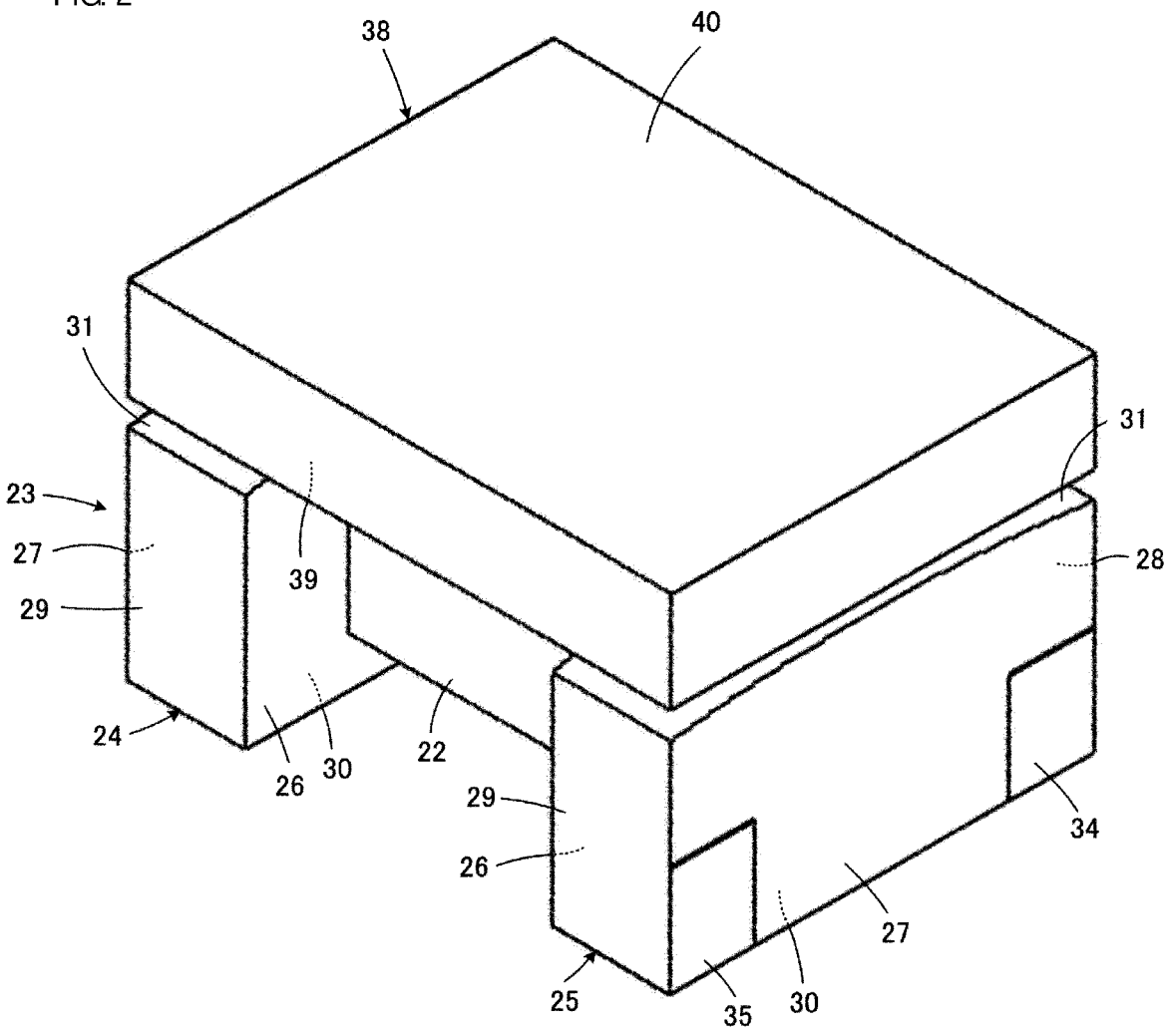
FIG. 2 is a perspective view that illustrates a drum core and a planar core included in the coil component illustrated in FIG. 1 in a state where they are assembled.

A coil component 21 according to a first embodiment of the present disclosure is described with reference to FIGS. 1 to 4. One example of the illustrated coil component 21 constitutes a common-mode choke coil.

The coil component 21 includes a drum core 23 including a winding core portion 22 having first and second end portions opposite to each other in its axial direction. The drum core 23 includes first and second flange portions 24 and 25 disposed on the first and second end portions of the winding core portion 22, respectively. The drum core 23 is made of a magnetic material, more specifically, a magnetic substance, such as nickel-zinc ferrite, an amorphous metal material, a resin containing magnetic powder, or the like. One example of the winding core portion 22 in the drum core 23 may form a substantially rectangular columnar shape with a substantially rectangular cross section.

Each of the first and second flange portions 24 and 25 has an inner end surface 26 facing an inner side being near to the winding core portion 22 and positioning the corresponding end surface of the winding core portion 22 and an outer end surface 27 facing an outer side being opposite to the inner side (side near to the inner end surface 26). Each of the first and second flange portions 24 and 25 has first and second side surfaces 28 and 29 linking the inner end surface 26 and outer end surface 27 and facing mutually opposite sides. Each of the first and second flange portions 24 and 25 further includes a bottom surface 30 linking the inner end surface 26 and the outer end surface 27, linking the first and second side surfaces 28 and 29, and placed so as to face a mounting substrate side when being mounted and a top surface 31 opposite to the bottom surface 30.

In the illustrated embodiment, the inner end surface 26 is substantially parallel to the outer end surface 27. The inner end surface 26 may be inclined toward the outer end surface 27.

First and second terminal electrodes 32 and 33 (see FIG. 4) are disposed on the first flange portion 24. Third and fourth terminal electrodes 34 and 35 (see FIGS. 1 and 2) are disposed on the second flange portion 25. The first and second terminal electrodes 32 and 33 extend from the bottom surface 30 of the first flange portion 24 to a portion of the outer end surface 27. The third and fourth terminal electrodes 34 and 35 extend from the bottom surface 30 of the second flange portion 25 to a portion of the outer end surface 27.

The terminal electrodes 32 to 35 may be formed by applying conductive paste containing silver as its conductive component and baking it. The terminal electrodes 32 to 35 may be formed by, instead of baking the conductive paste, bonding a terminal metal part made of a conductive metal to the flange portions 24 and 25.

The terminal electrodes 32 to 35 may be covered with plating if needed. One example plating method used here may be the electrolytic plating method. By the application of plating, for example, a nickel plating film may be formed and a tin plating film may be formed thereon or a copper plating film may be formed, a nickel plating film may be formed thereon, and a tin plating film may be formed thereon.

As schematically illustrated in FIG. 1, for example, two wires 36 and 37 are spirally wound around the winding core portion 22 in the same direction. One example of the wires 36 and 37 may be made of a copper wire covered with an electrical insulating resin, such as polyurethane or polyesterimide. The wires 36 and 37 may have a multilayer winding structure if needed. Although not specifically illustrated, a first end of the first wire 36 is connected to the first terminal electrode 32, and a second end of the first wire 36 is connected to the third terminal electrode 34, the second end being opposite to the first end. A first end of the second wire 37 is connected to the second terminal electrode 33, and a second end of the second wire 37 is connected to the fourth terminal electrode 35, the second end being opposite to the first end. These terminal electrodes 32 to 35 and the wires 36 and 37 may be connected by, for example, thermocompression bonding.

The coil component 21 further includes a planar core 38 placed over the gap between the first and second flange portions 24 and 25. The planar core 38 constitutes a closed magnetic path in coordination with the drum core 23. Like the drum core 23, the planar core 38 is made of a magnetic material, more specifically, a magnetic substance, such as nickel-zinc ferrite, an amorphous metal material, a resin containing magnetic powder, or the like.

The planar core 38 has a lower principal surface 39 and an upper principal surface 40 facing in mutually opposite directions. The planar core 38 is fixed to the top surfaces 31 of the flange portions 24 and 25 in the state where the lower principal surface 39 faces the top surfaces 31 of the flange portions 24 and 25 with adhesive 41 (see FIG. 1) interposed therebetween. One example material of the adhesive 41 may be a material made of a thermosetting epoxy resin. By hot-pressing that material for about 10 minutes at about 150° C., the fixation of the planar core 38 and the flange portions 24 and 25 can be achieved.

Next, a characteristic configuration in the coil component 21 is described.

Figure 3:
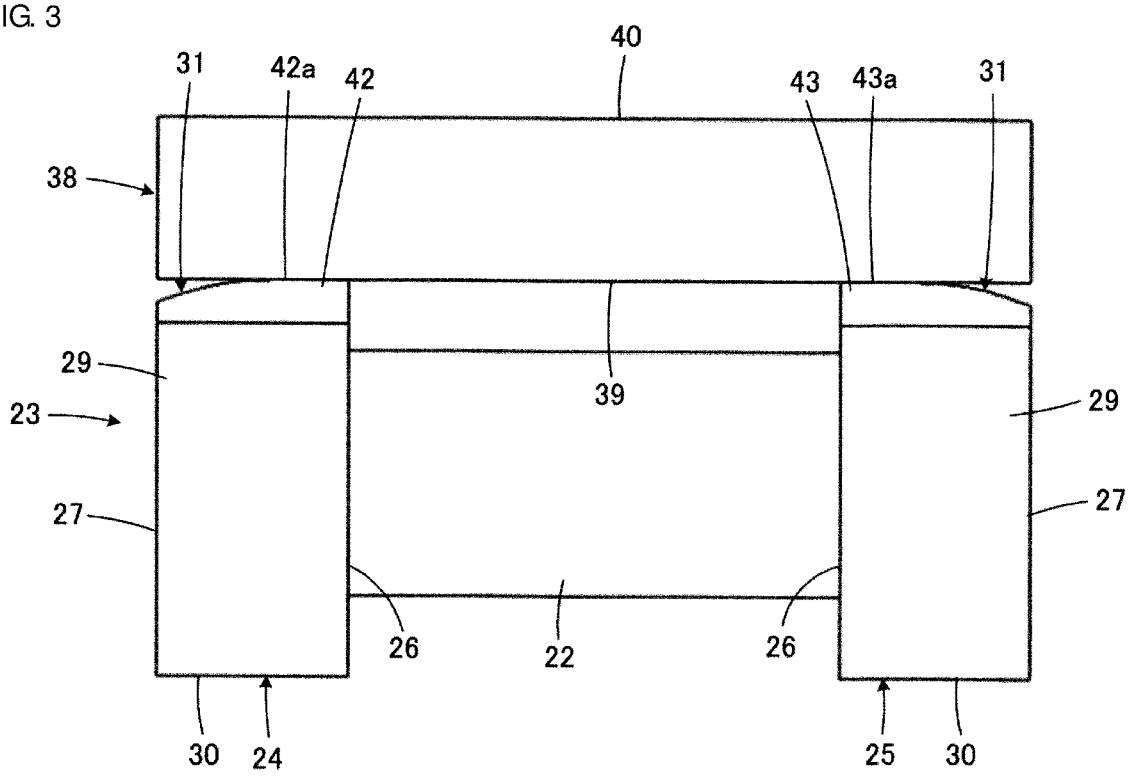
FIG. 3 is a front view that illustrates the drum core and planar core in the assembled state illustrated in FIG. 2.
Figure 4:
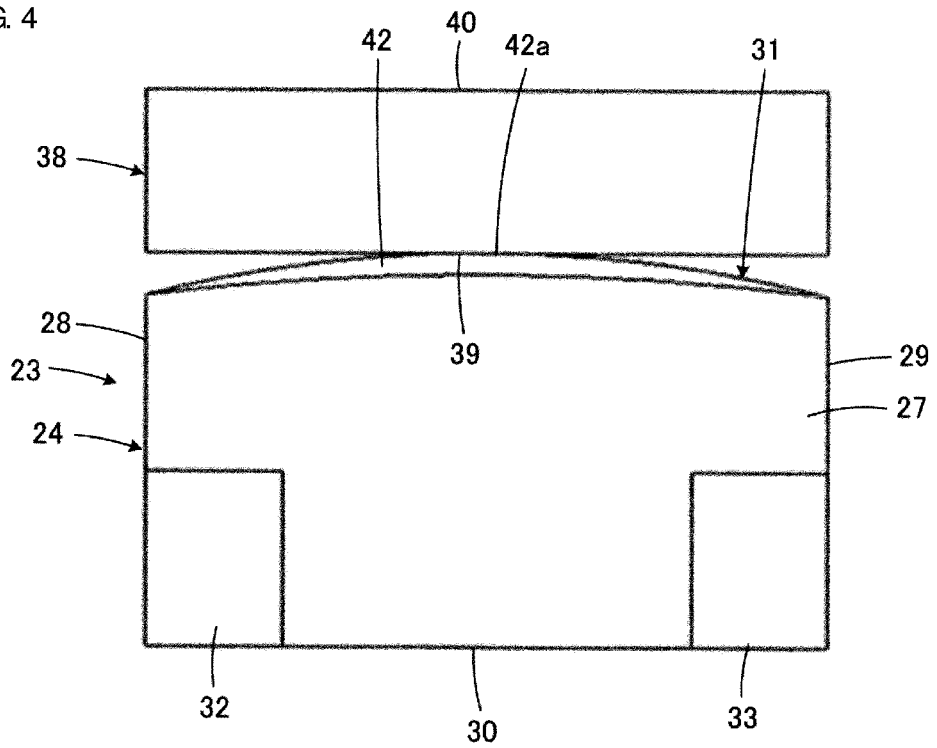
FIG. 4 is a left side view that illustrates the drum core and planar core in the assembled state illustrated in FIG. 2.

Focusing on the top surface 31 of each of the first and second flange portions 24 and 25, as illustrated well in FIGS. 3 and 4, the top surface 31 of the first flange portion 24 includes a first protrusion 42, and the top surface 31 of the second flange portion 25 includes a third protrusion 43. A vertex 42*a* of the first protrusion 42 is positioned closer to the inner end surface 26 of the first flange portion 24 than to the outer end surface 27. A vertex 43*a* of the third protrusion 43 is positioned closer to the inner end surface 26 of the second flange portion 25 than to the outer end surface 27. Thus, the top surfaces 31 of the first and second flange portions 24 and 25 are closer to the lower principal surface 39 of the planar core 38 at the vertices 42*a* and 43*a* than that at their peripheral portions.

In the present embodiment, the top surfaces 31 of the first and second flange portions 24 and 25 are closest to the lower principal surface 39 of the planar core 38 at the vertices 42*a* and 43*a*. In this configuration, the magnetic path formed of the drum core 23 and planar core 38 can be stable in a section with a shorter path of the magnetic path.

As described above, because the vertex 42*a* of the first protrusion 42 and the vertex 43*a* of the third protrusion 43 are closer to the inner end surface 26 of the first flange portion 24 and that of the second flange portion 25, respectively, the magnetic resistance can be reduced in a section with a shorter path of the magnetic path formed of the drum core 23 and planar core 38. Thus, the inductance is efficiently obtainable.

In bonding the drum core 23 and planar core 38, it is not necessary to have direct contact of the top surface 31 of each of the flange portions 24 and 25 with the lower principal surface 39 of the planar core 38. Therefore, a wide area for bonding by the adhesive 41 can be ensured. Accordingly, an adequate bonding strength between the drum core 23 and planar core 38 is obtainable, and at the same time, a reduction in inductance can be suppressed.

In particular, in the present embodiment, although not illustrated explicitly, the adhesive 41 is present all over the region where the top surface 31 of each of the first and second flange portions 24 and 25 and the lower principal surface 39 of the planar core 38 face each other, the region containing a location where the protrusions 42 and 43 face the lower principal surface 39 of the planar core 38. In this configuration, the adhesive 41 can be interposed between the flange portions 24 and 25 and the planar core 38 without having to rely on capillary action, and the bonding area between the flange portions 24 and 25 and the planar core 38 can be enlarged sufficiently. Consequently, the bonding strength between the flange portions 24 and 25 and the planar core 38 can be improved sufficiently.

The above-described phrase "all over the region" indicates substantially all over the region and permits the region to contain a portion where the adhesive 41 is absent at an outer edge or other area, such as a portion on a ridge of the top surfaces 31 of the first and second flange portions 24 and 25. In particular, in some cases, for example, if the ridge is curved by, for example, barrel finishing, the portion may not be defined as the region where the top surface 31 and the lower principal surface 39 face each other in a strict sense.

The present embodiment has a characteristic in which, on the side near to the outer end surfaces 27 with respect to the vertices 42*a* and 43*a*, the interval between the top surface 31 of each of the first and second flange portions 24 and 25 and the lower principal surface 39 of the planar core 38 widens from the side near to the inner end surface 26 of each of the first and second flange portions 24 and 25 toward the side near to the outer end surface 27, as well illustrated in FIG. 3. In this configuration, the adhesive 41 can be smoothly interposed between the top surface 31 of each of the flange portions 24 and 25 and the lower principal surface 39 of the planar core 38. In particular, the magnetic path passing through the side close to the outer end surface 27 and each of the flange portions 24 and 25 has a longer path in the magnetic path formed of the drum core 23 and planar core 38, and if the interval is extended in this region, the effect on the obtainment of inductance is relatively small. Accordingly, in the above-described configuration, the effect on an inductance reduction occurring with improvement in the bonding strength can be relatively small.

When a direction that is substantially perpendicular to the direction in which the winding core portion 22 extends and that is substantially perpendicular to the direction in which the bottom surface 30 and top surface 31 of each of the flange portions 24 and 25 face each other is the width direction, the vertex 42*a* of the first protrusion 42 and the vertex 43*a* of the third protrusion 43 are positioned in central portions of the top surfaces 31 of the flange portions 24 and 25 in the width direction, respectively, as well illustrated in FIG. 4. The interval between the top surface 31 of each of the flange portions 24 and 25 and the lower principal surface 39 of the planar core 38 widens from the central portion of each of the flange portions 24 and 25 in the width direction toward the first and second side surfaces 28 and 29. In this configuration, the adhesive 41 can be smoothly interposed between the top surface 31 of each of the flange portions 24 and 25 and the lower principal surface 39 of the planar core 38.

In the present embodiment, the slope to each of the vertex 42*a* of the first protrusion 42 and the vertex 43*a* of the third protrusion 43 has a convex spherical surface, as well illustrated in FIGS. 3 and 4.

Figure 5:
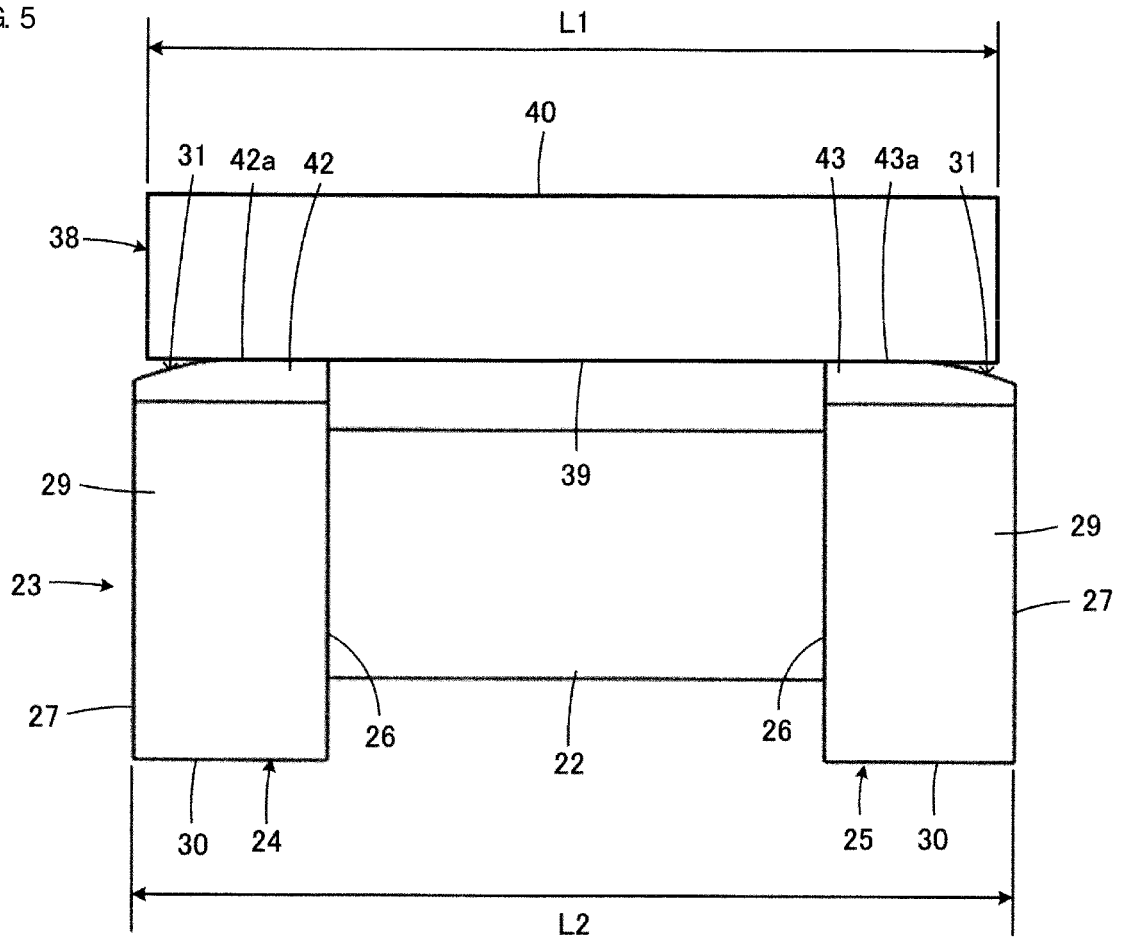
FIG. 5 is a front view that illustrates a drum core and a planar core included in a coil component according to a second embodiment of the present disclosure in a state in which they are assembled.

FIG. 5 is an illustration for describing a second embodiment of the present disclosure and corresponds to FIG. 3. In FIG. 5, the same reference numerals are used in elements corresponding to the elements illustrated in FIG. 3, and redundant description is omitted.

According to the characteristic configuration in the first embodiment described above, the top surfaces 31 of the first and second flange portions 24 and 25 include the protrusions 42 and 43 with the vertices 42*a* and 43*a* positioned closer to the inner end surface 26 than to the outer end surface 27. Thus, the length along the axial direction of the winding core portion 22 of the planar core 38 can be shorter than that of the drum core 23. The coil component adopting this configuration is the second embodiment illustrated in FIG. 5.

That is, in the second embodiment, for the length along the axial direction, the length L1 of the planar core 38 is shorter than the length L2 of the drum core 23. In this configuration, if the planar core 38 is slightly displaced with respect to the drum core 23, the external shape of the coil component can be recognized on the basis of the external shape of the drum core 23 in a mounting state, and thus the mounting position of the coil component can be accurately determined by image recognition. As described above, by positioning the vertex 42*a* of the first protrusion 42 and the vertex 43*a* of the third protrusion 43 on the sides closer to the inner end surfaces 26 of the flange portions 24 and 25, respectively, the magnetic resistance is reduced on the side closer to each of the inner end surfaces 26. Therefore, even when the dimension L1 is shorter than the dimension L2, the effect on the inductance can be small.

Figure 6:
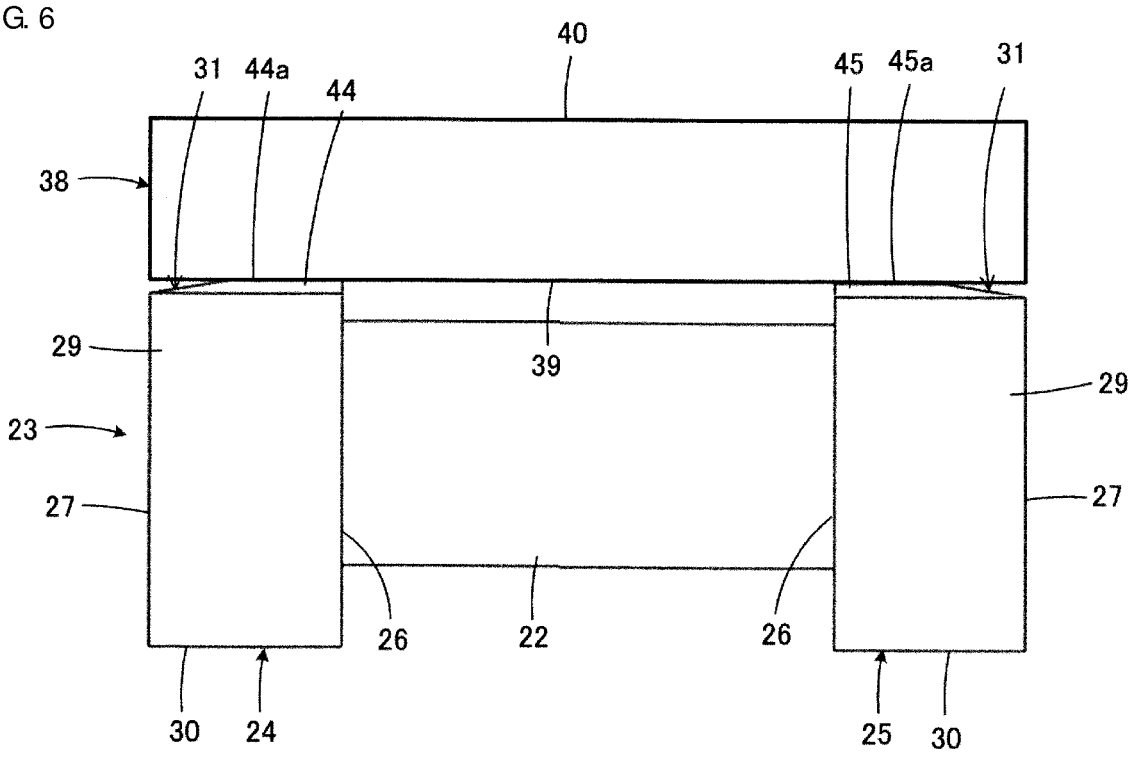
FIG. 6 is a front view that illustrates a drum core and a planar core included in a coil component according to a third embodiment of the present disclosure in a state in which they are assembled.
Figure 7:
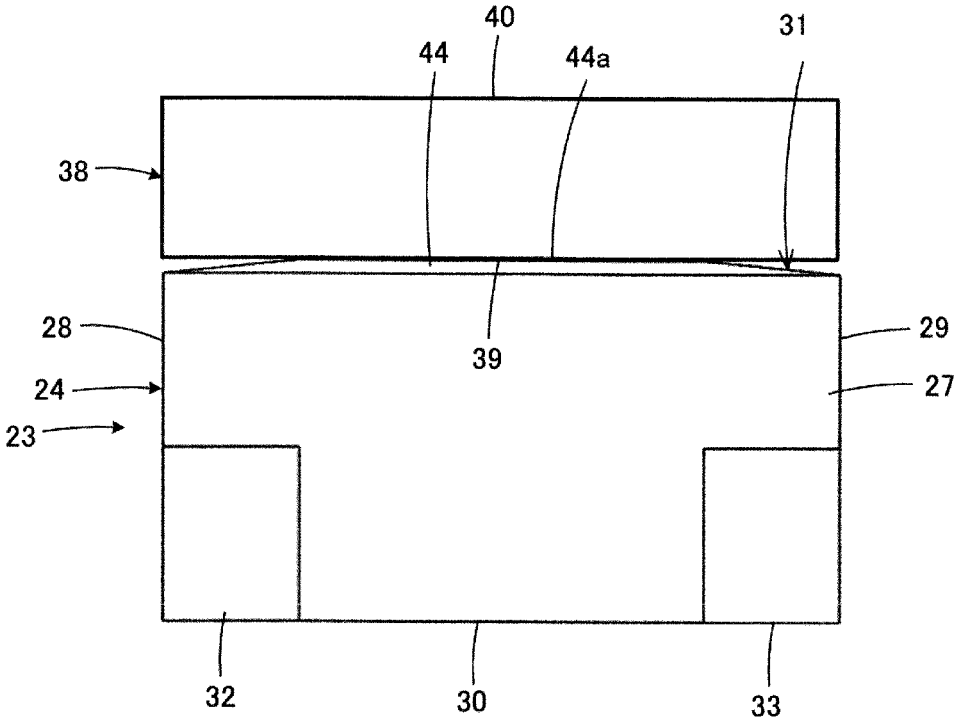
FIG. 7 is a left side view that illustrates the drum core and planar core in the assembled state illustrated in FIG. 6.

FIGS. 6 and 7 are illustrations for describing a third embodiment of the present disclosure. FIG. 6 corresponds to FIG. 3, and FIG. 7 corresponds to FIG. 4. In FIGS. 6 and 7, the same reference numerals are used in elements corresponding to the elements illustrated in FIGS. 3 and 4, and redundant description is omitted.

In the third embodiment, the shapes of first and third protrusions 44 and 45 are different from those of the first and third protrusions 42 and 43 in the first embodiment. The first and third protrusions 44 and 45 have relatively wide planes at vertices 44*a* and 45*a*. In the protrusions 44 and 45, the slope to each of the vertices 44*a* and 45*a* extends linearly in cross section.

The operational advantages from the first and third protrusions 44 and 45 in the third embodiment are substantially the same as those from the first and third protrusions 42 and 43 in the first embodiment.

Figure 8:
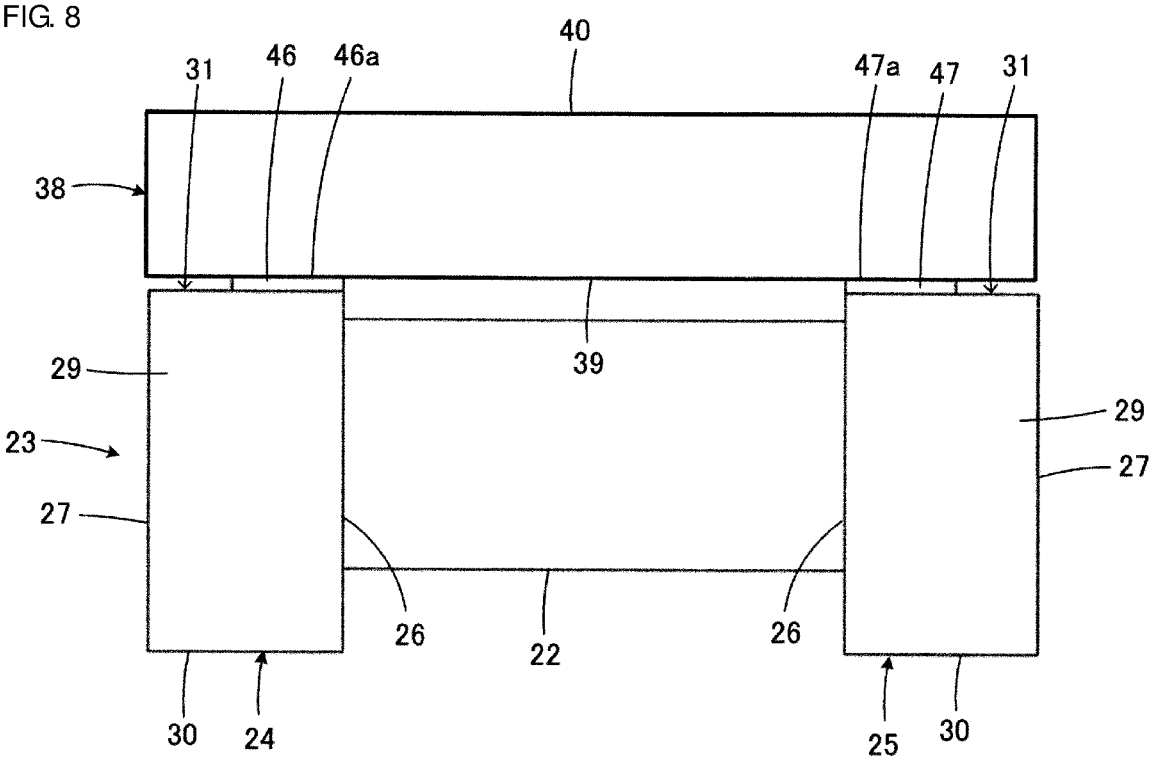
FIG. 8 is a front view that illustrates a drum core and a planar core included in a coil component according to a fourth embodiment of the present disclosure in a state in which they are assembled.
Figure 9:
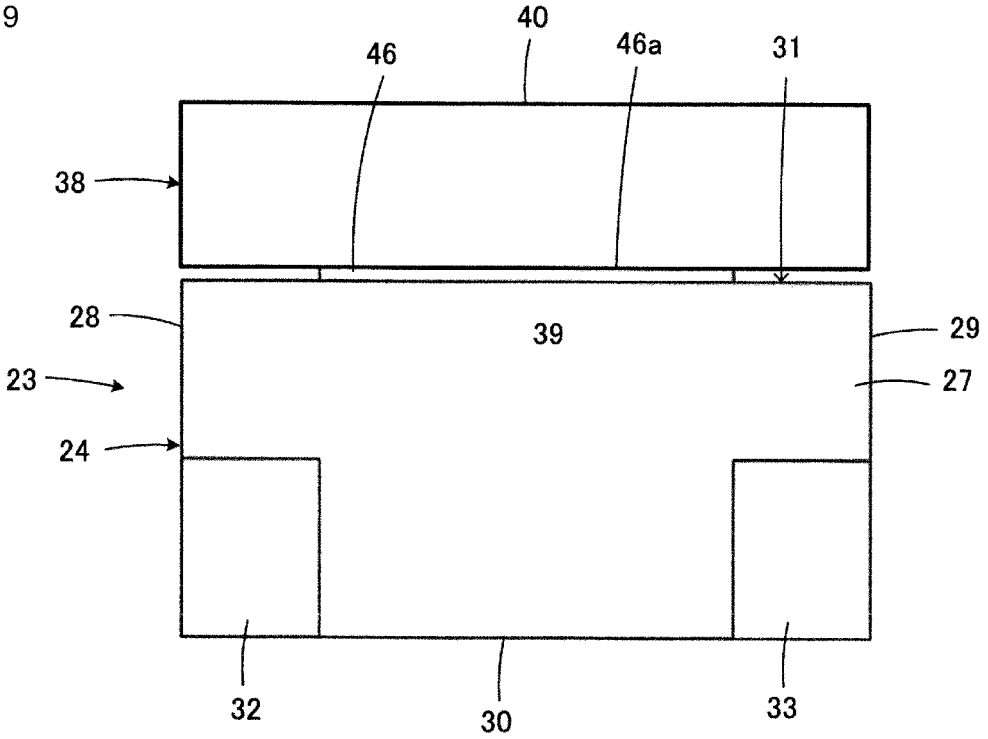
FIG. 9 is a left side view that illustrates the drum core and planar core in the assembled state illustrated in FIG. 8.

FIGS. 8 and 9 are illustrations for describing a fourth embodiment of the present disclosure. FIG. 8 corresponds to FIG. 3, and FIG. 9 corresponds to FIG. 4. In FIGS. 8 and 9, the same reference numerals are used in elements corresponding to the elements illustrated in FIGS. 3 and 4, and redundant description is omitted.

In the fourth embodiment, the shapes of first and third protrusions 46 and 47 are different from the corresponding ones in the first embodiment. Like in the case of the first and third protrusions 44 and 45 in the third embodiment, the first and third protrusions 46 and 47 have relatively wide planes at vertices 46*a* and 47*a*. The vertices 46*a* and 47*a* in the first and third protrusions 46 and 47 are defined by surrounding walls rising substantially perpendicularly from the top surfaces 31 of the flange portions 24 and 25.

The operational advantages from the first and third protrusions 46 and 47 in the fourth embodiment are substantially the same as those from the first and third protrusions 42 and 43 in the first embodiment.

FIGS. 10 to 13 are illustrations for describing a fifth embodiment of the present disclosure. Unlike FIGS. 2 to 4, FIGS. 10 to 13 do not illustrate the planar core 38 and illustrate only the drum core 23. In FIGS. 10 to 13, the same reference numerals are used in elements corresponding to the elements illustrated in FIGS. 2 to 4, and redundant description is omitted.

Figure 10:
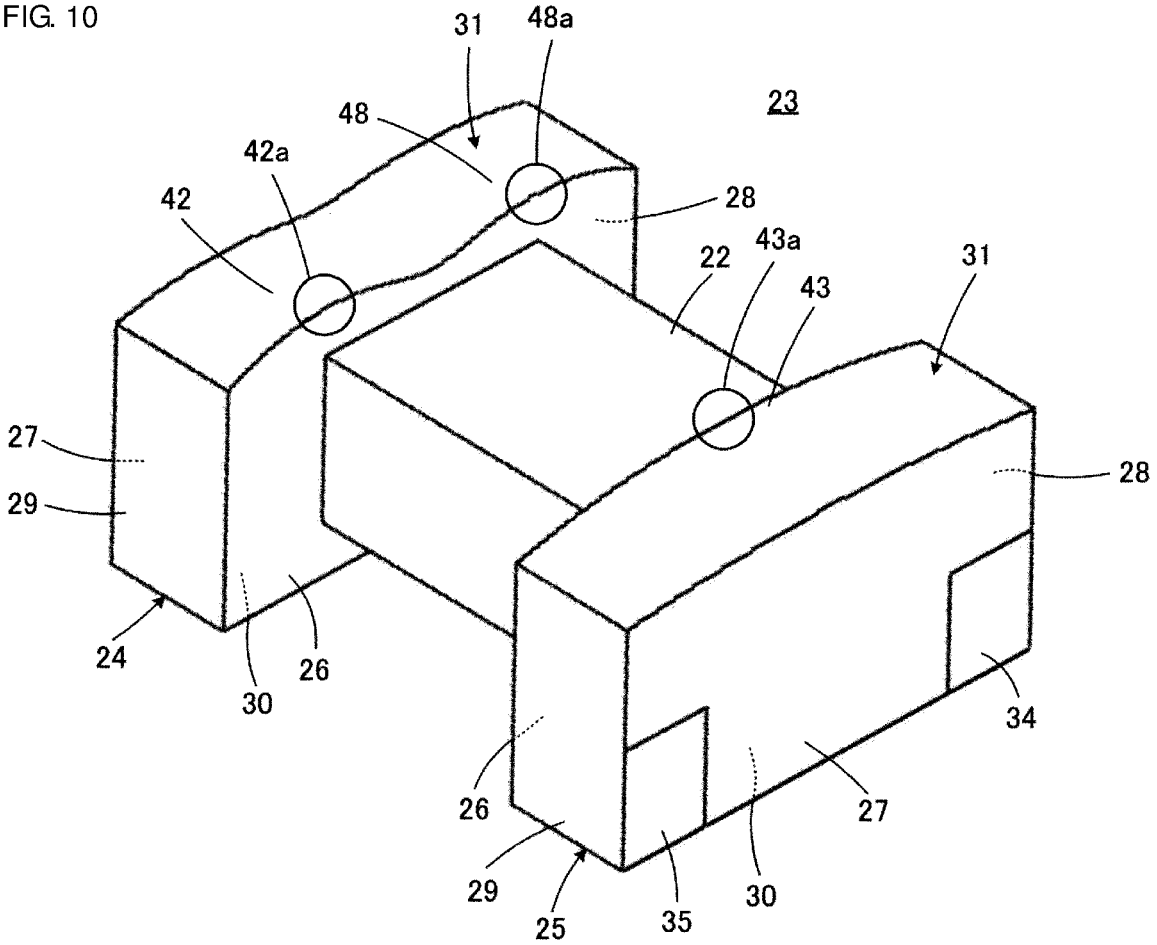
FIG. 10 is a perspective view that illustrates an outer appearance of a drum core included in a coil component according to a fifth embodiment of the present disclosure.
Figure 11:
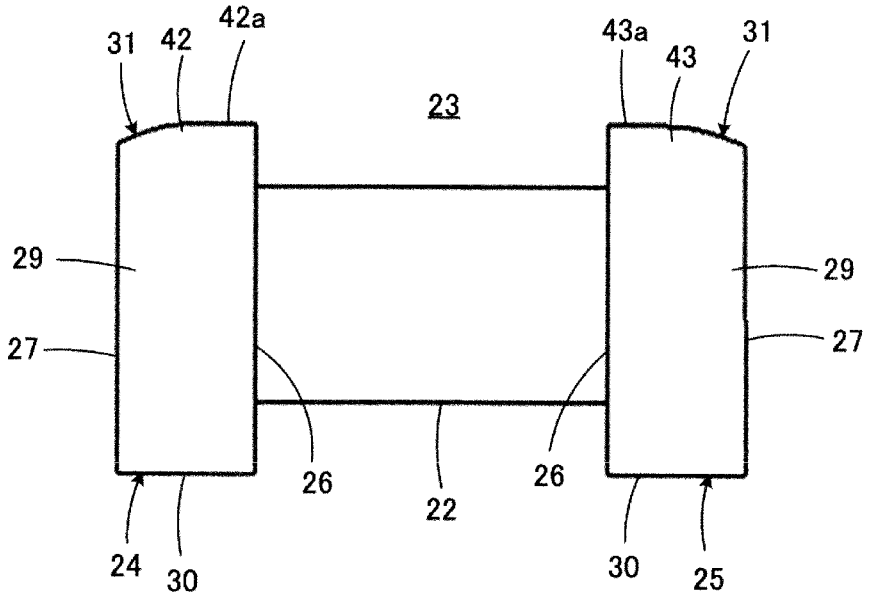
FIG. 11 is a front view that illustrates the drum core illustrated in FIG. 10.
Figure 12:
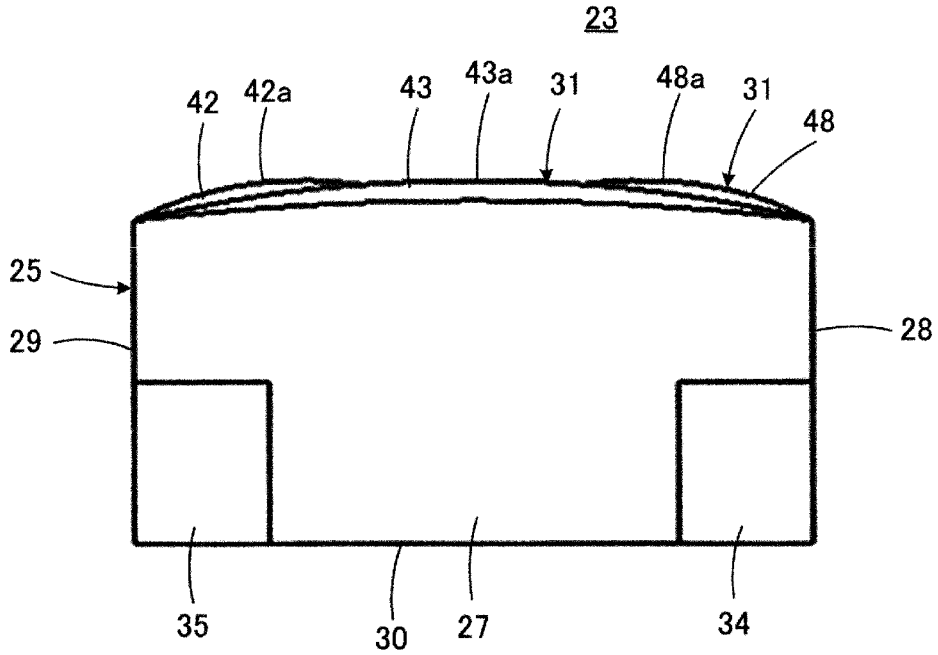
FIG. 12 is a right side view that illustrates the drum core illustrated in FIG. 10.
Figure 13:
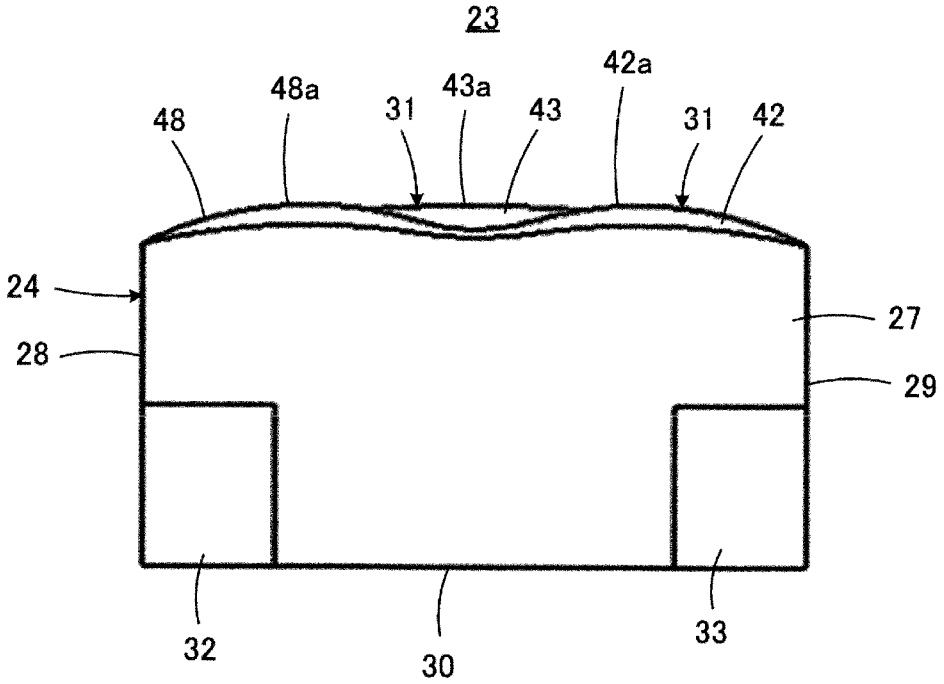
FIG. 13 is a left side view that illustrates the drum core illustrated in FIG. 10.
Figure 14:
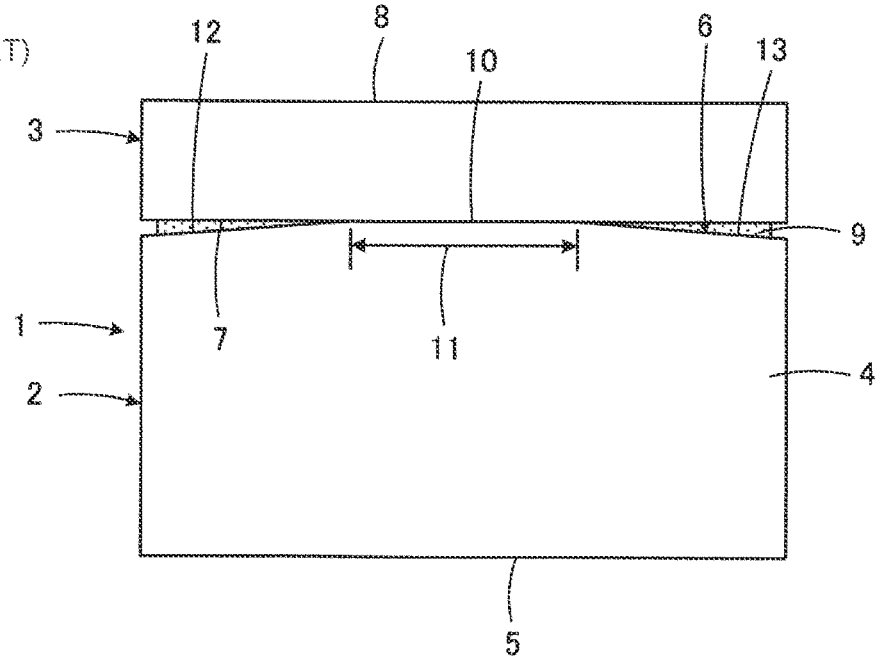
FIG. 14 (PRIOR ART)
FIG. 14 is a side view that illustrates one flange portion of a drum core and a planar core in a coil component described in Japanese Patent No. 5796603.

In the fifth embodiment, as in the case of the first embodiment, first, the first and second flange portions 24 and 25 include the first and third protrusions 42 and 43 in their respective top surfaces 31. In the fifth embodiment, the first flange portion 24 further includes a second protrusion 48 in the top surface 31 of the first flange portion 24, in addition to the first protrusion 42. In FIG. 10, the positions of the vertices 42*a*, 48*a*, and 43*a* of the first, second, and third protrusions 42, 48, and 43 are indicated by circles. The vertex 48*a* of the second protrusion 48 is arranged in a position different from the vertex 42*a* of the first protrusion 42.

The positions of the vertices 42*a*, 48*a*, and 43*a* of the first, second, and third protrusions 42, 48, and 43 are selected as described below. When a direction that is substantially perpendicular to the direction in which the winding core portion 22 extends and that is substantially perpendicular to the direction in which the bottom surface 30 and top surface 31 of each of the flange portions 24 and 25 face each other is the width direction, as illustrated in FIGS. 10 to 13, the position of the vertex 43*a* of the third protrusion 43 in the width direction may preferably be located between the position of the vertex 42*a* of the first protrusion 42 in the width direction and the position of the vertex 48*a* of the second protrusion 48 in the width direction. That is, when viewed from the axial direction, the vertex 43*a* of the third protrusion 43 may preferably be present between the vertex 42*a* of the first protrusion 42 and the vertex 48*a* of the second protrusion 48. More preferably, each of the vertex 42*a* of the first protrusion 42 and the vertex 48*a* of the second protrusion 48 may be in a position that deviates from the central portion of the top surface 31 of the first flange portion 24 along the width direction, whereas the vertex 43*a* of the third protrusion 43 may be in a central portion of the second top surface 31 of the second flange portion 25 in the width direction. That is, when viewed from the axial direction, the vertex 43*a* of the third protrusion 43 is positioned in the central portion of the second top surface 31 of the second flange portion 25. In this configuration, the attitude of the planar core (not illustrated) is more stabilized, and the magnetic resistance between the first and second flange portions 24 and 25 and the planar core is stable. Accordingly, variations in inductance of the coil component can be suppressed.

According to the fifth embodiment, because the top surface 31 of the first flange portion 24 has the second protrusion 48, the state in which the planar core (not illustrated) is supported at two points with respect to the top surface 31 of the first flange portion 24 can be achieved, and thus the attitude of the planar core with respect to the drum core 23 can be maintained with stability.

As is apparent from the above, the top surface 31 of the first flange portion 24 and the second top surface 31 (surface facing the same side of the top surface 31 of the first flange portion 24) of the second flange portion 25 may have different shapes. Accordingly, the coil component may have a configuration in which the top surface 31 of the first flange portion 24 includes the first protrusion 42 and the second top surface 31 of the second flange portion 25 has no protrusion. As in the above-described embodiment, the configuration in which the second top surface 31 has the third protrusion 43 with the vertex 43*a* positioned closer to the inner surface (inner end surface 26) of the second flange portion 25 than to the outer surface (outer end surface 27) can provide better advantages.

The present disclosure is described above in relation to the illustrated embodiments. Various modification examples can be made within the scope of the present disclosure.

For example, because the ridge of each of the flange portions 24 and 25 near to the inner end surface 26 may often be a curved surface formed by, for example, barrel finishing, the gap between the planar core 38 and each of the flange portions 24 and 25 on the side near to the inner end surface 26 with respect to the vertices 42*a* to 48*a* may be somewhat extended.

The coil component 21, which constitutes a common-mode choke coil in the above-described embodiments, may constitute a single coil or other devices, such as a transformer or a balun. Accordingly, the number of wires may be any number, that is, one or three or more. In response to the number of wires, the number of terminal electrodes on the flange portions may be changed.

In configuring the coil component according to the present disclosure, among different embodiments described in this specification, the configurations may be replaced in part or combined.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum core including a winding core portion, and a flange portion disposed on an end portion of the winding core portion in an axial direction thereof and made of a magnetic material, the flange portion including an inner end surface, an outer end surface, a bottom surface, and a top surface, the inner end surface facing an inner side being near to the winding core portion and positioning the end portion of the winding core portion, the outer end surface facing an outer side being opposite to the inner side, the bottom surface linking the inner end surface and the outer end surface and placed so as to face a mounting substrate side when being mounted, the top surface being opposite to the bottom surface, and the top surface includes a protrusion having a highest point positioned closer to the inner end surface than to the outer end surface and a curved portion extending from the highest point towards the outer end surface;

a planar core having a lower principal surface and made of a magnetic material, the lower principal surface of the planar core being fixed to the top surface with an adhesive interposed therebetween; and a wire wound around the winding core portion.

2. The coil component according to claim 1, wherein the top surface is closest to the lower principal surface at the highest point.

3. The coil component according to claim 1, wherein an interval between the top surface and the lower principal surface on a side near to the outer end surface with respect to the highest point widens from a side near to the inner end surface toward the side near to the outer end surface.

4. The coil component according to claim 1, wherein the adhesive is present over substantially all of a region where the top surface and the lower principal surface face each other, the region containing the protrusion.

5. The coil component according to claim 1, wherein the top surface further includes a second protrusion with a highest point in a position different from the highest point of the protrusion.

6. The coil component according to claim 5, wherein the drum core includes a second flange portion disposed on a second end portion of the winding core portion opposite to the end portion in the axial direction, the second flange portion has a second top surface facing the same side as the top surface and including a third protrusion with a highest point positioned closer to a surface of the second flange portion on the inner side than to a surface thereof on the outer side, and when viewed from the axial direction, the highest point of the third protrusion is located between the highest point of the first protrusion and the highest point of the second protrusion.

7. The coil component according to claim 6, wherein the highest point of the third protrusion is positioned in a central portion of the second top surface when viewed from the axial direction.

8. The coil component according to claim 1, wherein a length of the planar core along the axial direction is shorter than that of the drum core.

9. The coil component according to claim 2, wherein an interval between the top surface and the lower principal surface on a side near to the outer end surface with respect to the highest point widens from a side near to the inner end surface toward the side near to the outer end surface.

10. The coil component according to claim 2, wherein the adhesive is present over substantially all of a region where the top surface and the lower principal surface face each other, the region containing the protrusion.

11. The coil component according to claim 3, wherein the adhesive is present over substantially all of a region where the top surface and the lower principal surface face each other, the region containing the protrusion.

12. The coil component according to claim 2, wherein the top surface further includes a second protrusion with a highest point in a position different from the highest point of the protrusion.

13. The coil component according to claim 3, wherein the top surface further includes a second protrusion with a highest point in a position different from the highest point of the protrusion.

14. The coil component according to claim 4, wherein the top surface further includes a second protrusion with a highest point in a position different from the highest point of the protrusion.

15. The coil component according to claim 2, wherein a length of the planar core along the axial direction is shorter than that of the drum core.

16. The coil component according to claim 3, wherein a length of the planar core along the axial direction is shorter than that of the drum core.

17. The coil component according to claim 4, wherein a length of the planar core along the axial direction is shorter than that of the drum core.

18. The coil component according to claim 5, wherein a length of the planar core along the axial direction is shorter than that of the drum core.

19. The coil component according to claim 6, wherein a length of the planar core along the axial direction is shorter than that of the drum core.

20. The coil component according to claim 7, wherein a length of the planar core along the axial direction is shorter than that of the drum core.

* * * * *